US005646588A

United States Patent [19]

Cannon

[11] Patent Number: 5,646,588

[45] Date of Patent: Jul. 8, 1997

[54] STROKE ELONGATION DEVICE FOR AN ELECTROMAGNETIC ACTUATOR

[75] Inventor: Howard N. Cannon, Peoria, Ill.

[73] Assignee: Caterpillar Inc., Peoria, Ill.

[21] Appl. No.: 308,239

[22] Filed: Sep. 19, 1994

[51] Int. Cl.[6] ..... H01F 3/00

[52] U.S. Cl. ..... 335/281; 335/276

[58] Field of Search ..... 335/281, 276, 335/262, 270, 274

[56] References Cited

U.S. PATENT DOCUMENTS

| | | | |
|---|---|---|---|
| 3,995,243 | 11/1976 | Malmborg | 335/179 |
| 4,034,841 | 7/1977 | Ohyama et al. . | |
| 4,218,669 | 8/1980 | Hitchcock et al. . | |
| 4,585,361 | 4/1986 | West et al. . | |
| 4,633,209 | 12/1986 | Belbel et al. . | |
| 4,688,012 | 8/1987 | Bohg et al. . | |
| 5,355,108 | 10/1994 | Morinigo et al. | 335/262 |

FOREIGN PATENT DOCUMENTS

| | | |
|---|---|---|
| 0025382 | 3/1981 | European Pat. Off. . |

*Primary Examiner*—Lincoln Donovan
*Attorney, Agent, or Firm*—David M. Masterson; Mario J. Donato

[57] ABSTRACT

An electromagnetic actuator is disclosed. The actuator includes a core having an inner and outer pole that defines a pole face. A coil of windings is disposed in the core and produces a magnetic field. An armature is moveable between first and second positions in response to the force produced by the magnetic field. A stroke elongation device is disposed adjacent to the outer pole piece and closely spaced from the armature. The stroke elongation device increases the pull-in force of the electromagnetic actuator.

6 Claims, 3 Drawing Sheets

STROKE ELONGATION DEVICE FOR AN ELECTROMAGNETIC ACTUATOR

TECHNICAL FIELD

This invention relates generally to a device for extending the stroke of an electromagnetic actuator and, more particularly, to a device that increases the force of an electromagnetic actuator providing the actuator to be used in long stroke applications.

BACKGROUND ART

Electromagnetic actuators are used in a variety of applications. For example, one electromagnetic actuator design may be used for long stroke applications, while another electromagnetic actuator design may be used for short stroke applications. However, rather than have multiple actuator designs, it is desirable to have one actuator design for use in multiple applications to decrease the overall cost of the actuator.

Additionally, latching type electromagnetic actuators require high forces to quickly move from an unlatched position to a latched position. However, because the air gap of the electromagnetic actuator is large while the actuator is unlatched, only a small force is initially produced by the actuator. Consequently, it is desirable to increase the initial force of the actuator to improve its response.

DISCLOSURE OF THE INVENTION

In one aspect of the present invention, an electromagnetic actuator is disclosed. The actuator includes a core having an inner and outer pole that defines a pole face. A coil of windings is disposed in the core and produces a magnetic field. An armature is moveable between first and second positions in response to the magnetic field. A stroke elongation device is disposed adjacent to the outer pole piece and closely spaced from the armature. The stroke elongation device increases the pull-in force of the electromagnetic actuator.

BRIEF DESCRIPTION OF THE DRAWINGS

For a better understanding of the present invention, reference may be made to the accompanying drawings in which.

BEST MODE FOR CARRYING OUT THE INVENTION

Figure 1:
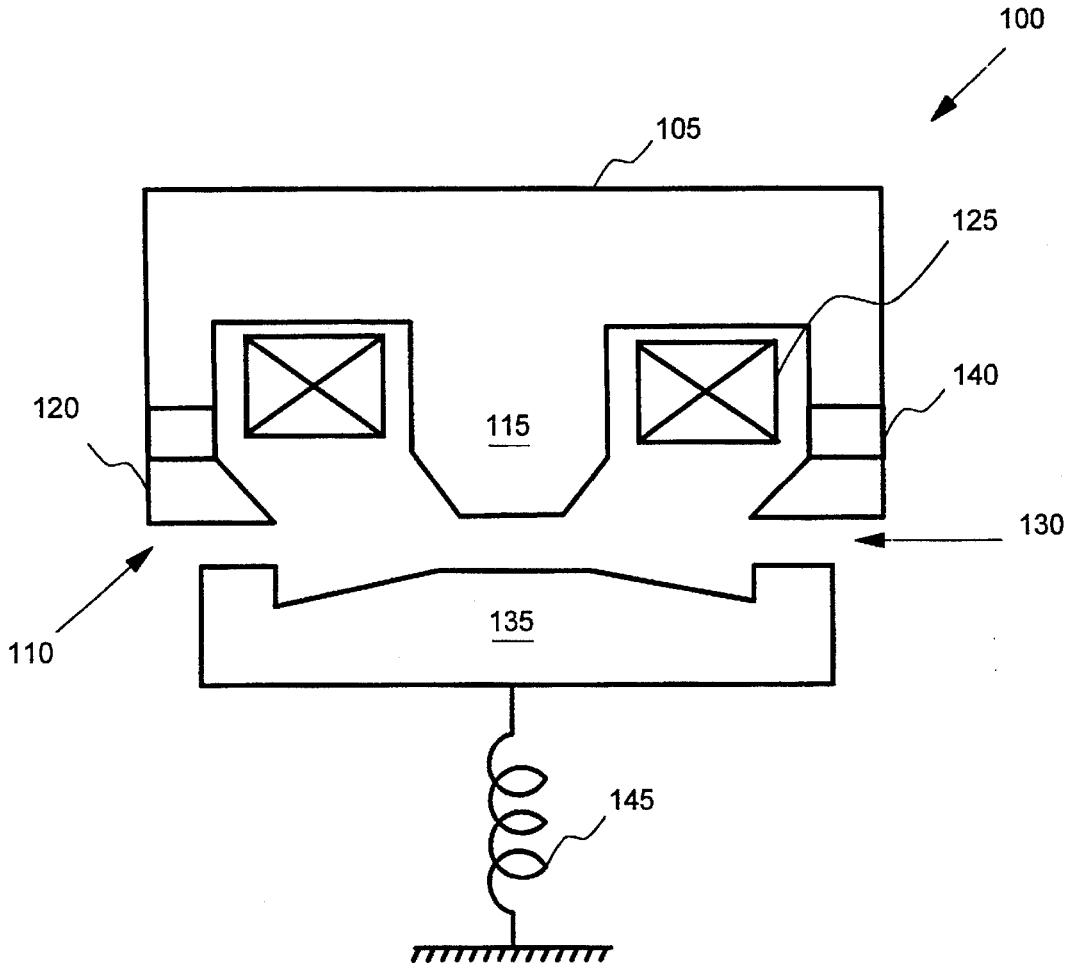
FIG. 1 shows a typical short stroke electromagnetic actuator.

FIG. 1 shows a typical electromagnetic actuator 100. The actuator includes a core 105 having an inner and outer pole 115,120 that defines a pole face 110. The core may have a round or square E-frame configuration. A coil of windings 125 is disposed in the core. Upon energization of the coil, a magnetic flux is introduced in an air gap 130 to pull the armature 135 to the pole face. The armature 135 is moveable between first and second positions. The electromagnetic actuator may include a permanent magnet 140 disposed in the outer pole piece to latch the armature against the pole face at the first position. The electromagnetic actuator may additionally include a spring 145 to maintain the armature a predetermined distance from the pole face at the second position.

Figure 2A:
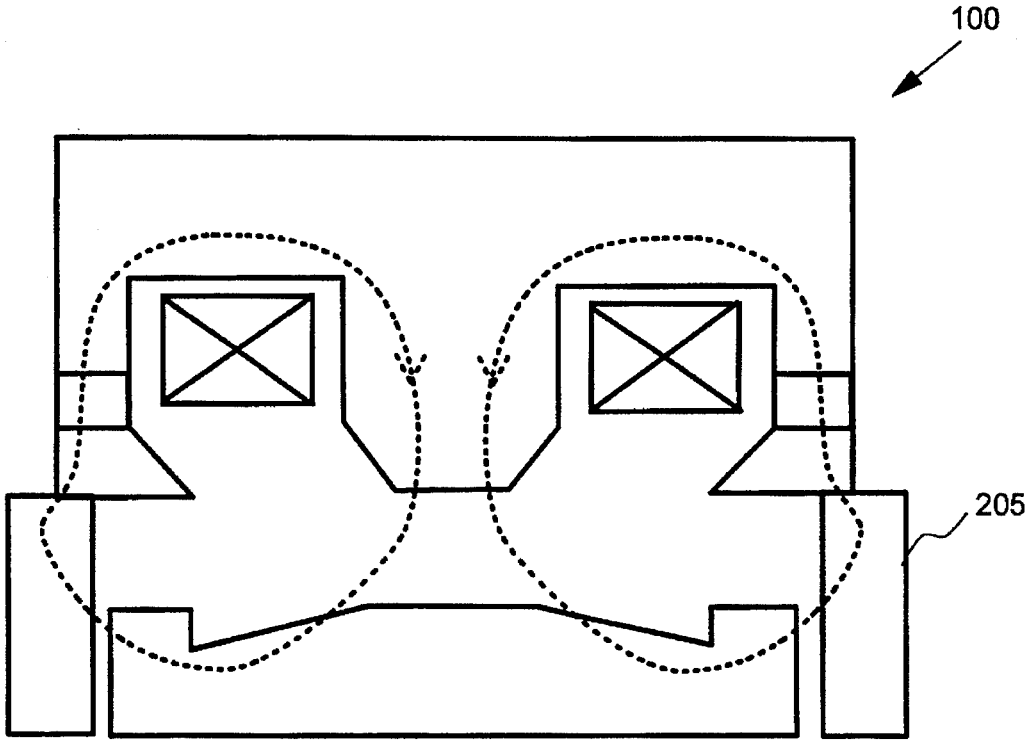
FIGS. 2A,B show the electromagnetic actuator of FIG. 1 with the addition of a stroke elongation device.
Figure 2B:
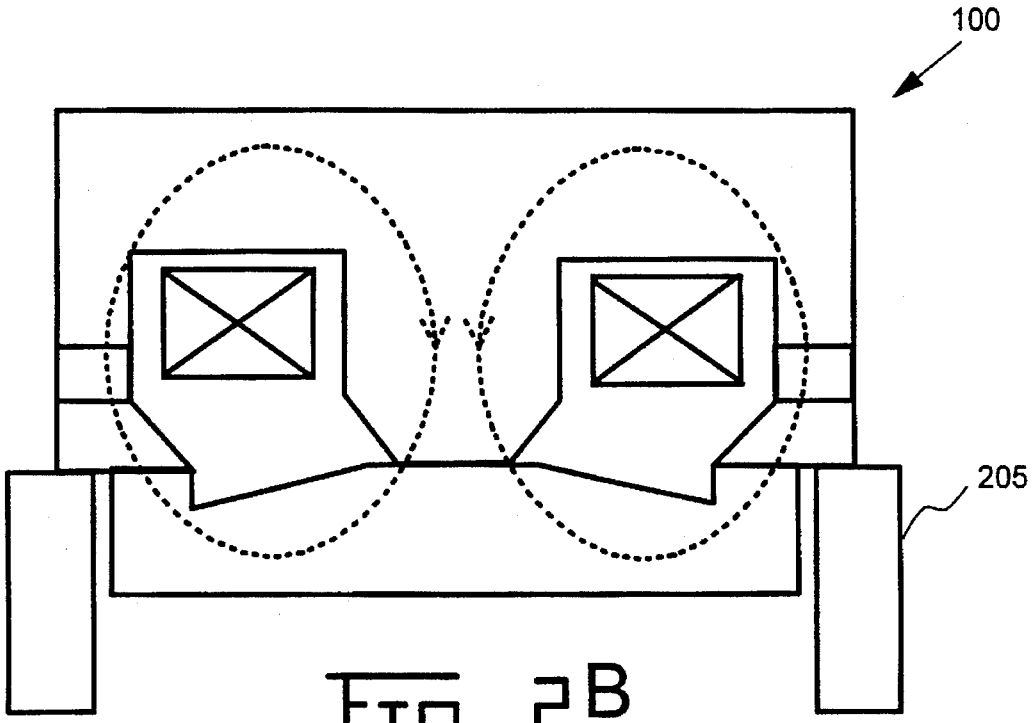

FIGS. 2A,B show a stroke elongation device 205 that is added to the electromagnetic actuator of FIG. 1. The stroke elongation device is disposed adjacent to the outer pole piece. Advantageously, the stroke elongation device provides for the short stroke electromagnetic actuator of FIG. 1 to be used in longer stroke applications. Shown in FIG. 2A, the electromagnetic actuator is positioned in an unlatched position. Accordingly, a large air gap exists between the armature and the pole face.

Figure 3:
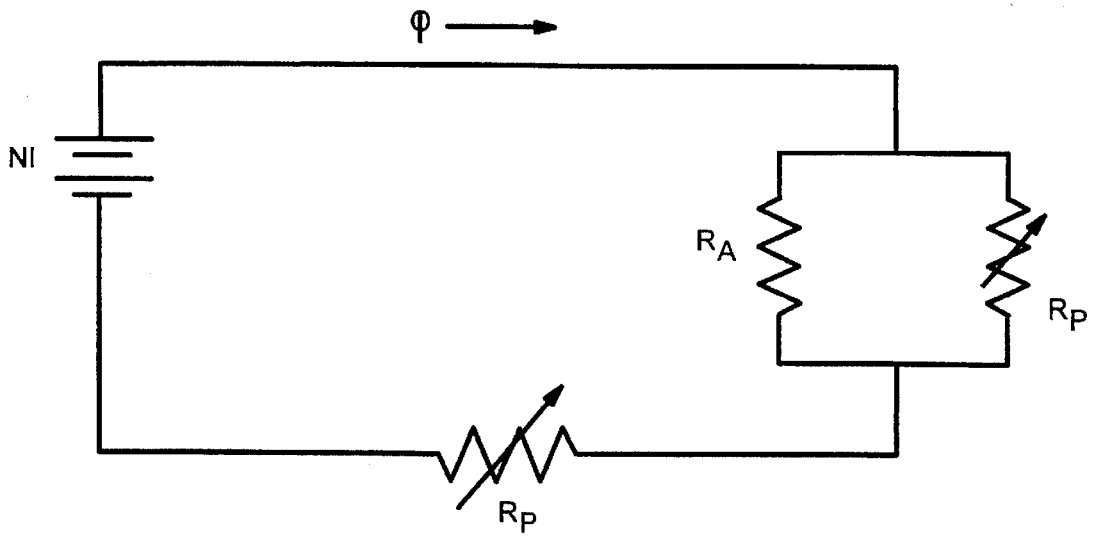
FIG. 3 shows an electrical analog of the magnetic circuit of the electromagnetic actuator.

Reference is now made to FIG. 3 which shows the electrical analog of the magnetic circuit of the electromagnetic actuator, in which the reluctance of the steel is neglected. $R_P$ is the reluctance of the air gap between the armature and one of the poles, and $R_A$ is the reluctance of the air gap between the armature and the elongation device. Note that, $R_P$ is variable because the reluctance value is a function of the changing gap between the armature and pole. $R_A$, however, is constant. The total flux is equal to:

$$\phi = \frac{NI}{R_P + \frac{R_A R_P}{R_A + R_P}}$$

Upon energization of the coil, the electromagnetic actuator is unlatched and $R_P$ is relatively large. However, $R_A$ is relatively small as compared to $R_P$. Thus, $R_A$ minimizes the total circuit reluctance to provide a greater amount of flux; thereby, creating a greater force at the inner pole to quickly "pull" the armature toward the pole face.

As the armature moves closer to the pole face, the gap decreases, which increases the flux through the outer pole. Consequently, the effect of $R_A$ becomes lessened, while still allowing for a reasonably high holding or latching force.

Figure 4:
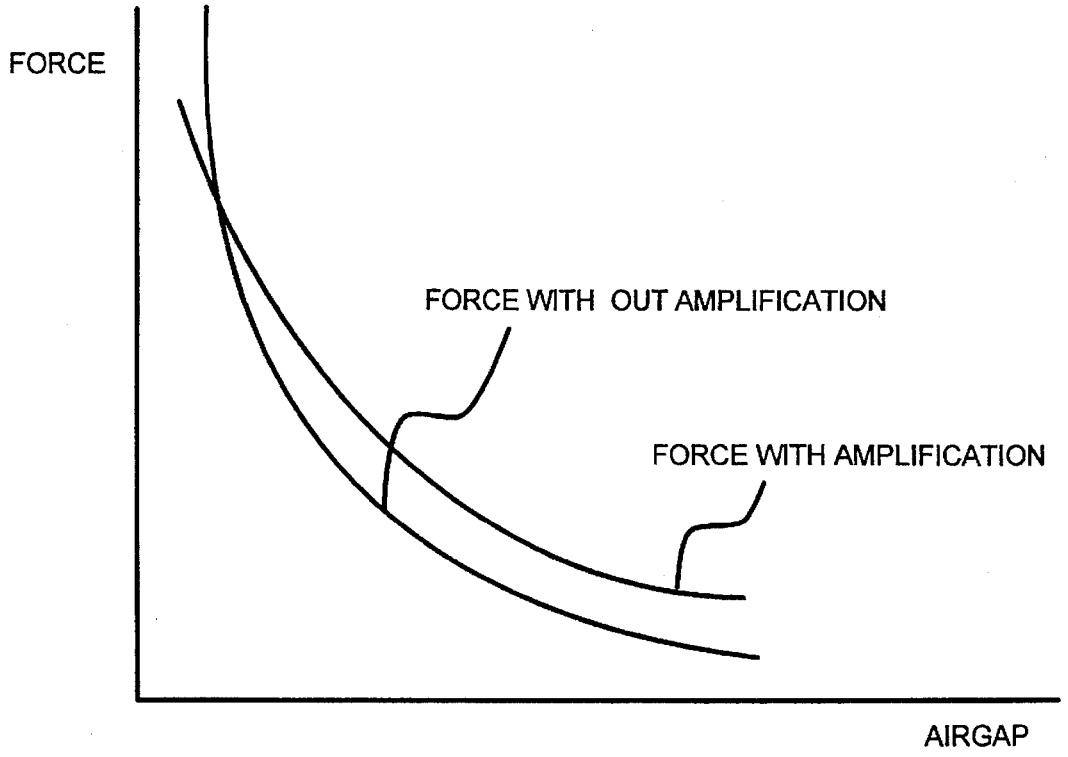
FIG. 4 shows a force stroke curve of the electromagnetic actuators is FIGS. 1 and 2.

FIG. 4 shows a pair of curves illustrating the produced electromagnetic forces verses the air gap. One curve represents the force produced by a typical electromagnetic actuator, while the other curve represents the force produced by a typical electromagnetic actuator that has a stroke elongation device attached thereto. Note that the shape of the stroke elongation device may be modified to produce a desired force.

Thus, while the present invention has been particularly shown and described with reference to the preferred embodiment above, it will be understood by those skilled in the art that various additional embodiments may be contemplated without departing from the spirit and scope of the present invention.

Industrial Applicability

In one application, the present invention may be utilized to extend the stroke of a solenoid to allow the solenoid to be used in a variety of applications. Thus, because one solenoid design is utilized for multiple applications, the overall cost of the component may be decreased.

Moreover, in another application, the present invention increases the response of a latching type solenoid. For example, the stroke elongation device increases the "pull-in" force, yet has little adverse effect on the "latching" force.

Other aspects, objects and advantages of the present invention can be obtained from a study of the drawings, the disclosure and the appended claims.

I claim:

1. An apparatus, comprising:

an electromagnetic actuator, including:

a core having an inner and outer pole that defines a pole face;

a coil of windings being disposed in the core and adapted to produce a magnetic field; and an armature being moveable between first and second positions in response to the force produced by the magnetic field, the armature defining an air gap between the armature and the pole face; and a stroke elongation device being disposed adjacent to the outer pole piece and closely spaced from the armature, wherein the stroke elongation device is adapted to increase the pull-in force of the electromagnetic actuator.

2. An apparatus, as set forth in claim 1, wherein the magnetic reluctance of the gap between the armature and the stroke elongation device is less than the magnetic reluctance of the gap between the armature and pole face in response to the armature being at the second position.

3. An apparatus, as set forth in claim 2, wherein the stroke elongation device increases the stroke of the electromagnetic actuator.

4. An apparatus, as set forth in claim 2, wherein the stroke elongation device increases the pull-in force of the electromagnetic actuator while having little adverse effect on the latching force.

5. An apparatus, as set forth in claim 4, including a permanent magnet disposed in the outer pole and adapted to latch the armature to the pole face.

6. An apparatus, as set forth in claim 5, including a spring connected to the armature, the spring adapted to maintain the armature at the second position.

* * * * *